United States Patent [19]

Evans

[11] 4,002,400

[45] Jan. 11, 1977

[54] ELECTRICAL CONNECTOR

[75] Inventor: Robert Franklin Evans, New Cumberland, Pa.

[73] Assignee: E. I. Du Pont de Nemours and Company, Wilmington, Del.

[22] Filed: Aug. 1, 1975

[21] Appl. No.: 601,073

[52] U.S. Cl. ..... 339/258 R

[51] Int. Cl.[2] ..... H01R 13/12

[58] Field of Search ..... 339/217, 258, 259, 262

[56] References Cited

UNITED STATES PATENTS

| | | | |
|---|---|---|---|
| 2,004,076 | 6/1935 | Knutson | 339/258 T |
| 2,539,230 | 1/1951 | Craig | 339/258 P |
| 3,389,371 | 6/1968 | Maynard | 339/217 S |
| 3,652,976 | 3/1972 | Tymkewicz | 339/184 R |
| 3,862,792 | 1/1975 | Jayne | 339/258 R |

FOREIGN PATENTS OR APPLICATIONS

| | | | |
|---|---|---|---|
| 1,813,739 | 6/1970 | Germany | 339/258 R |
| 1,447,759 | 6/1966 | France | 339/258 R |

*Primary Examiner*—Joseph H. McGlynn

[57] ABSTRACT

An electrical connector for forming a high amperage connection with a male pin includes a number of beams surrounding the pin and a collar surrounding the beams. The end of the pin is inserted into the connector and moved past outer contacts on the beams and engages inner contacts on the beams to force the inner contacts radially apart and rock the beams about the inner surface of the collar to force the outer contacts against the pin. Alternate inner contacts are axially spaced to reduce the insertion force.

11 Claims, 4 Drawing Figures

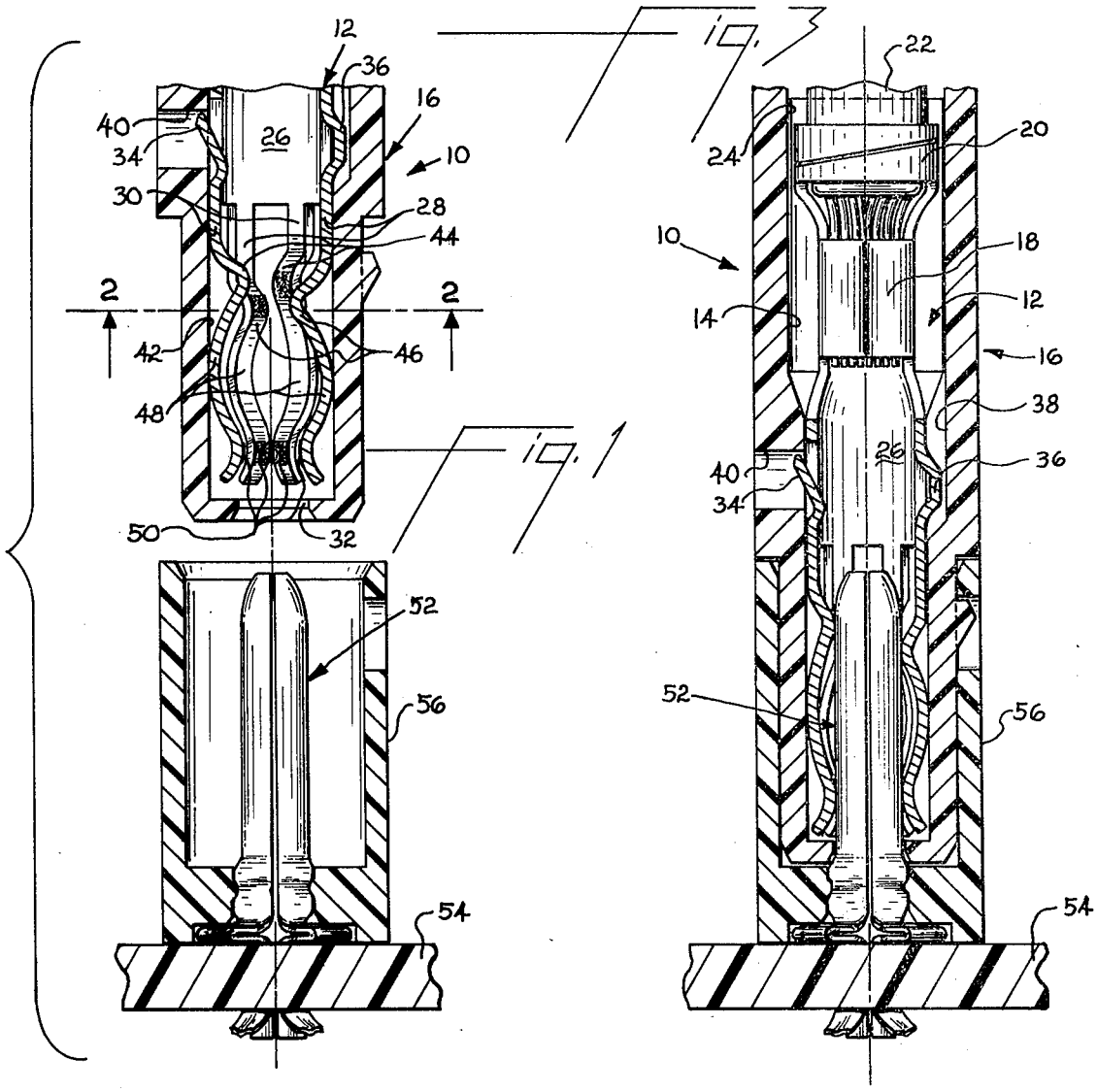
Fig. 1
Fig. 3
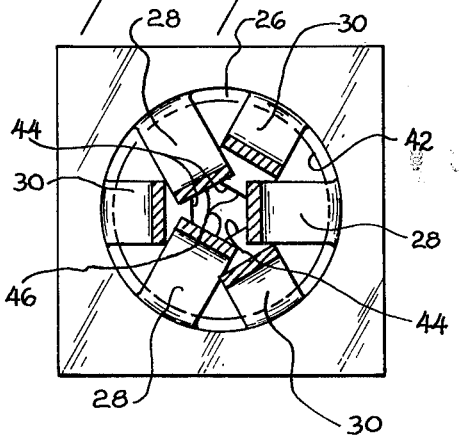
Fig. 2
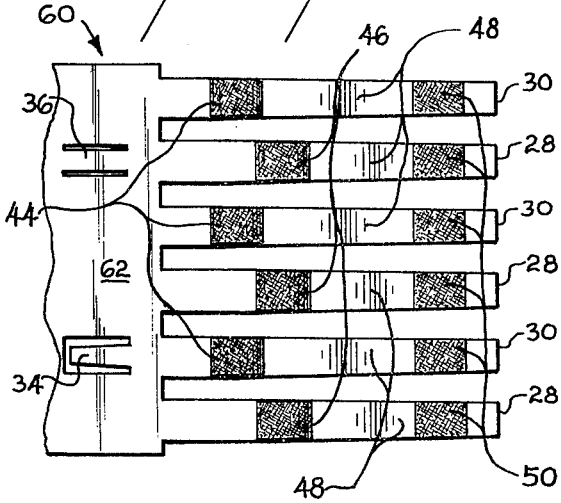
Fig. 4

ELECTRICAL CONNECTOR

The invention relates to electrical connectors and particularly to socket-type connectors for removable engagement with male contact pins. U.S. Pat. No. 2,942,231 discloses a conventional electrical connector for a male pin.

A number of electrical connectors may be mounted in an assembly for engagement with a plurality of male contacts projecting from a support and arranged conventionally in a rectangular pattern. See U.S. Pat. No. 3,656,086.

The conventional miniature socket-type electrical connectors for mounting on male pins have a limited current carrying capacity and for that reason are not suitable for use in high amperage applications. Conventional high amperage electrical connectors are relatively bulky and can not be mounted together in a dense assembly as presently required by the electronics industry. Because male pins are small and easily arranged on a support in a dense grid, the size of the conventional high amperage electrical connectors prevents desired miniaturization of high amperage power distribution panels such as the type used in computers and other electronic equipment where power is distributed from a source to a number of conductors extending to individual modules or components. The bulk of conventional power distribution panels is a particular problem in applications, such as computers, where other electronic components have been miniaturized and the size of the distribution panel prevents further miniaturization of the equipment.

The invention provides a small and reliable high amperage electrical connector which may be used in dense power distribution panels. Each electrical connector includes a plurality of beams arranged generally cylindrically around a male pin with each beam having a pair of electrical contacts engaging the pin to provide redundant electrical contacts between the pin and the electrical connector.

As the pin is moved into the electrical connector, the lead end freely passes outer contacts on the beams and then engages inner contacts on adjacent beams at different distances along the insertion path so that the contacts of adjacent beams are successively stressed to form high pressure electrical connections. The successive stressing of the beams reduces the insertion force required to form the redundant electrical connections between the pin and the electrical connector. The beams are wider than in conventional connectors and provide sufficient cross-sectional area to carry high amperage current safely.

Other objects and features of the invention will become apparent as the description proceeds, especially when taken in conjunction with the accompanying drawings illustrating the invention, of which there is one sheet. IN THE DRAWINGS FIG. 1 is a sectional view of a female electrical connector in accordance with the invention in position to be mounted on a male pin;

FIG. 2 is a sectional view taken along line 2—2 of FIG. 1;

FIG. 3 is a view similar to FIG. 1 following assembly of the connector and pin; and FIG. 4 is a view of part of a preform used in the manufacture of the metal socket used in the electrical connector.

Electrical connector 10 includes a metal female socket terminal 12 positioned within the interior recess 14 of a hollow square insulating body 16. The terminal 12 is preferably stamp-formed from flat sheet metal stock and includes a wire crimp barrel 18 and an insulation crimp barrel 20 at one end for establishing electrical and physical connection with an insulated conductor 22 extending outwardly of opening 24 at one end of body 16.

A plurality of contact beams 28 and 30 extend longitudinally from the central tubular portion 26 of the terminal in a direction toward the pin-receiving opening 32 at the end of body 16 away from opening 24. Latch 34 and projection 36 extend radially outwardly from tubular portion 26. When the terminal 12 is inserted into the insulating body 16 through opening 24 and moved to the seated position as illustrated, projection 36 extends into slot 38 in the body so that the terminal is angularly oriented and the latch is depressed and then snaps back to lock against shoulder 40 and secure the terminal in the body. Projection 36 seats against the end of slot 38 to prevent over-insertion of the terminal.

As illustrated, the tubular portion 26 is fitted snugly within an inner cylindrical wall 42 of recess 14. Alternate beams 28 and 30 extend from the end of the cylindrical portion 26 32 along the wall 42 in a generally serpentine configuration. Beams 28 and 30 include inner contact bends 44 and 46, bows 48 engaging surface 42 and outer contact bends 50 adjacent the opening 32. Thus, wall 42 serves as a collar circumscribing bows 48. The inner contact bends 44 on beams 30 are spaced further from the opening 32 than the inner contact bends 46 on beams 28. As shown in FIG. 2, beams 28 and 30 alternate around the circumference of the terminal so that the inner contact bends 44 and 46 carried by these beams are alternately spaced or staggered longitudinally of the terminal.

The width of the beams 28 and 30 at the inner bends requires longitudinal staggering in order to position the bends equidistant from the longitudinal axis for engagement with the contact pin. The spacing permits the use of beams wider than the reduced width otherwise required. The increased width of the beams improves their spring characteristics and current carrying capacity. The staggered inner ends also reduce the insertion force needed to form an electrical connection between the terminal and a male pin.

FIG. 4 illustrates a broken away preform 60 used in the manufacture of terminal 12 having a base 62 which is subsequently rolled to form the tubular portion 26 of the terminal. Serpentinely shaped beams 28 and 30 extend from one end of base 62. The staggered positioning of the inner contact bends 44 and 46 is clearly illustrated. Each beam is tapered from a point outwardly of the inner contact bend to the outer contact bend so that the width is reduced outwardly of the inner bend. The reduction in width of the beams permits bows 48 to engage surface 42 and the outer bends to be positioned together for engagement with the pin adjacent opening 32. The uniform tapering of the beams away from the inner contact bends assures uniform stress loading of the beams upon insertion of the pin.

The electrical connector 10 is used to form an electrical connection with a male pin 52 which may be mounted on a circuit board 54 and surrounded by an insulating housing 56. FIG. 1 illustrates the connector 10 in position for engagement with the male pin. The connector is moved toward the pin so that the lead end of the pin passes through opening 32 and past the outer contact bends 50. The outer contact bends lightly wipe the pin. With further insertion, the lead end of the pin engages inner bends 46 of beams 28 and as it passes, forces the bends radially outwardly so that the bows 48 of beams 28 rock or pivot on the surface 42 and the outer bends 50 are forced radially inwardly against the pin. The result is that high pressure electrical connections are formed between the pin and the inner and outer contact bends of each beam 28. Continued insertion of the pin brings its lead end into engagement with the inner contact bends 44 of beams 30 and with movement of the pin to the fully inserted position of FIG. 3, similarly stress beams 30 to form high pressure electrical connections between the pin and both contact bends on the beams 30.

The outer contact bends are spaced for initial sliding engagement with the pin so that when the lead end of the pin engages the inner contact bends and rocks or pivots the beams, the outer ends are immediately forced against the pin to achieve the highest pressure connection possible without wasting any movement.

Electrical connectors 10 may use female socket terminals formed of flat 0.018 inch thick solder coated brass having six beams as illustrated with a beam width of 0.055 inch adjacent the cylindrical portion and a width of 0.040 inch at the outer contact bends. The connector is mounted on a contact pin having a diameter of 0.092 inch. The tests show that the electrical connector has a current carrying capacity of 30 amps so that, on average, each connection between the pin and the socket terminal carried 2½ amps of current. The current carrying capacity of the pin was maintained after repeated disengagement and re-engagement with the pin.

Because the inner bends are axially spaced, the beams 28 are stressed to form electrical connections with the pin prior to stressing of beams 30 so that the insertion force required to mate the connector with the pin is substantially reduced over that required were the bows located at the same axial position so that the pin simultaneously engage the bends and stress the beams.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. An electrical connector comprising a conductive female socket terminal having a tubular portion, contact means for forming an electrical connection with a circuit member, and a plurality of contact beams projecting longitudinally from the tubular portion and arranged generally cylindrically around its axis, each beam including an inner electrical contact facing the axis adjacent said portion, an outer electrical contact facing the axis adjacent the end of the beam, and a pivot contact facing away from the axis and located between said electrical contacts; and a collar surrounding said beams, the inner surface of the collar engaging the pivot contacts to prevent movement thereof away from the axis, alternate inner electrical contacts being spaced from each other a distance along the axis whereby upon insertion of a pin into the space between the beams the lead end of the pin passes the outer electrical contacts and engages the longitudinally spaced inner electrical contacts to move the same away from the axis and rock their respective beams about the pivot contacts so that the outer contacts are forced against the pin.

2. An electrical connector as in claim 1 wherein the contact means includes a crimp barrel at the opposite end of said body from said beams.

3. An electrical connector as in claim 1 wherein each electrical contact comprises an inwardly directed bend formed in the length of the beam and wherein each pivot contact comprises a bowed portion of the beam extending between adjacent bends.

4. An electrical connector as in claim 1 wherein the female socket terminal is formed from thin metal stock, the outer electrical contacts are grouped together around the axis and the width of the beams decreases from the inner to the outer electrical contacts.

5. An electrical connector as in claim 1, including a hollow open-ended insulating body surrounding the electrical connector, said collar forming one end of the body, and locking means for securing the socket terminal and the insulating body together.

6. An electrical connector as in claim 5, including orientation means for angularly positioning the socket terminal in the insulating body and wherein said locking means comprises a shoulder and latch connection.

7. An electrical connector comprising a conductive female socket terminal having a tubular portion, contact means at one end of said portion for forming an electrical connection between with an insulated conductor, and a plurality of contact beams projecting longitudinally from the other end of said portion and arranged generally cylindrically around the longitudinal axis of the terminal, each beam including first and second electrical contacts facing the axis, said first and second electrical contacts being spaced apart from each other along the axis, and a pivot contact facing away from the axis and located between the first and second electrical contacts; and a collar surrounding said beams, the inner surface of the collar engaging the pivot contacts to prevent movement thereof away from the axis, alternate first electrical contacts being spaced differentially from said portion whereby, upon insertion of a pin into the space between the beams, the lead end of the pin passes said second electrical contacts, engages alternate first contacts and then the remaining first contacts to move the same away from the axis and rock the beams about the pivot contact so that the second electrical contacts are forced against the pin.

8. An electrical connector as in claim 7 wherein the first electrical contacts are located between said portion and the second electrical contacts.

9. An electrical connector as in claim 8 wherein said contact means includes a crimp barrel.

10. An electrical connector as in claim 9 wherein the female socket terminal is formed from thin metal stock and the width of the beams decreases from the first electrical contacts to the second electrical contacts.

11. An electrical connector as in claim 10 wherein said electrical contacts comprise bends formed in the beams facing the axis and wherein the pivot contacts comprise outwardly bowed portions of the beams extending between adjacent bends.

* * * * *